US008391516B2

(12) United States Patent
Fletcher

(10) Patent No.: US 8,391,516 B2
(45) Date of Patent: Mar. 5, 2013

(54) METHOD OF USING AN AUDIO DEVICE FOR IMPROVING SOUND REPRODUCTION AND LISTENING ENJOYMENT

(75) Inventor: Edward Stuart Fletcher, Torquay (GB)

(73) Assignee: Airsound LLP, Torquay (GB)

( * ) Notice: Subject to any disclaimer, the term of this patent is extended or adjusted under 35 U.S.C. 154(b) by 325 days.

(21) Appl. No.: 12/733,238

(22) PCT Filed: Aug. 14, 2008

(86) PCT No.: PCT/GB2008/002745

§ 371 (c)(1),
(2), (4) Date: Jun. 2, 2010

(87) PCT Pub. No.: WO2009/022135

PCT Pub. Date: Feb. 19, 2009

(65) Prior Publication Data

US 2010/0239108 A1 Sep. 23, 2010

(30) Foreign Application Priority Data

Aug. 15, 2007 (GB) ..... 0715953.6

(51) Int. Cl.
*H04R 25/00* (2006.01)

(52) U.S. Cl. ..... 381/151; 381/334; 381/182; 381/395

(58) Field of Classification Search ..... 381/151
See application file for complete search history.

(56) References Cited

U.S. PATENT DOCUMENTS

| | | | | |
|---|---|---|---|---|
| 5,109,416 | A * | 4/1992 | Croft | 381/304 |
| 5,617,477 | A * | 4/1997 | Boyden | 381/309 |
| 5,687,244 | A * | 11/1997 | Untersander | 381/151 |
| 5,784,478 | A * | 7/1998 | Untersander | 381/151 |
| 6,301,367 | B1 * | 10/2001 | Boyden et al. | 381/376 |
| 2003/0012397 | A1 * | 1/2003 | Gurner | 381/386 |
| 2005/0221867 | A1 * | 10/2005 | Zurek et al. | 455/569.1 |
| 2006/0067534 | A1 * | 3/2006 | Mizuta et al. | 381/1 |
| 2006/0072773 | A1 * | 4/2006 | Hughes et al. | 381/304 |
| 2006/0147056 | A1 * | 7/2006 | Klayman | 381/97 |
| 2007/0038164 | A1 * | 2/2007 | Afshar | 601/47 |

FOREIGN PATENT DOCUMENTS

| | | |
|---|---|---|
| EP | 0 009 116 A | 4/1980 |
| FR | 2 803 714 A | 7/2001 |

* cited by examiner

*Primary Examiner* — Christopher Uhlir
(74) *Attorney, Agent, or Firm* — Kilpatrick Townsend & Stockton

(57) ABSTRACT

A method of using an audio device (2) for improving a user's (1) listening experience. The audio device has a transducer (12) for producing output sound and the method comprises the steps of driving the transducer to produce an output sound and placing the audio device against the body of the user so that the user experiences a physical response to the sound while simultaneously listening to the audio device. The audio device may be arranged to produce a resonance in a part of the user's body. Preferably the audio device is positioned on the user's chest to produce a resonance in the chest cavity of the user's body. The audio device may comprise a sum and difference speaker system.

15 Claims, 3 Drawing Sheets

METHOD OF USING AN AUDIO DEVICE FOR IMPROVING SOUND REPRODUCTION AND LISTENING ENJOYMENT

The present invention relates to sound reproduction and listening enjoyment and in particular relates to a method of using an audio device for improving a user's listening experience.

Portable music players have been known in the art for many years. Originally such devices were based on audio cassettes, which were later generally superseded by compact disc players. In more recent years, the trend has been for portable music players to be based on MP3 digital audio files that can be stored on relatively small hand-held devices, such as flash-memory players, personal digital assistants (PDAs) and mobile telephones.

In all cases however, the user of the player typically listens to the music via 'in-ear' style headphones or low-power loudspeakers built into, or attached to, the player. Although the sound reproduced by such players is usually of good quality, it is generally not possible for the user to experience the full audio effect and dynamic range of the original sound recording due to the inherent limitations of the headphones and loudspeakers typically used with portable music players.

Human hearing is principally a function of the ears and the quality of any reproduced sound will depend largely on how the user hears that sound. However, not all sound is sensed by the ears, as a significant proportion of the sound is also sensed by other parts of the body. In particular, low frequency sound components, typically in the frequency range of around 200 Hz to around 1 kHz, are sensed via vibrations through the body, with the chest area being a particularly sensitive region to low frequency vibrations.

If a user is able to 'feel' as well as hear a reproduced sound, then it is believed that their perception of that sound is significantly improved, thereby leading to a much more enjoyable listening experience. However, due to the typically limited low frequency response and generally low fidelity of headphones and integral loudspeakers of portable music players, low frequency vibrations are usually not induced in the user and therefore they do not usually sense or 'feel' the low frequency components of the reproduced sound. As a result, the user only typically experiences the sound with limited low frequency information, which means that little or no use is made of the body's natural response to the sound, which may thereby diminish the user's overall enjoyment of the music.

Moreover, as typical headphones and integral loudspeakers of portable music players are generally limited in their ability to reproduce high quality stereo recordings, a significant amount of stereo information may also be lost during playback of the music, which may further contribute to a low quality reproduction of the recorded sound.

The present invention seeks to provide a method of using an audio device for improving a user's listening experience of reproduced sound, particularly music. It is an object of at least some embodiments of the invention to provide for increased enjoyment of the reproduced sound, especially of stereo sound, by making use of the user's natural bodily response to the sound.

By 'audio device' we mean a device that is capable of reproducing audible sound which may include a device that is capable of receiving an input signal and producing output sound.

According to the present invention there is provided a method of using an audio device for improving a user's listening experience, the audio device having a transducer for producing output sound, the method comprising the steps of:

driving the transducer to produce an output sound; and placing the audio device against the body of the user so that the user experiences a physical response to the sound while simultaneously listening to the audio device.

By placing the audio device against the body of the user the output sound is able to induce the body's natural response to the sound, such that the user is able to 'feel' as well as hear the sound. In this way, the combined effect of the perception of feeling the sound, together with hearing the sound, improves the user's listening experience and increases their overall enjoyment of the sound. Hence, where the sound corresponds to a piece of music, the user will experience a much more rewarding rendition of the music than if he/she were to simply listen to the sound via the headphones or integral loudspeakers of the portable music player.

In accordance with the invention, the use of the audio device in this way induces a physical response in the body of the user that may produce a resonance in a part of the user's body. In most, if not all, embodiments of the invention, the use is intended to produce at least a partial resonance of the chest cavity of the user. As the chest cavity is susceptible to low frequency stimulation, the low frequency components of the output sound may be used to induce a 'cavity resonance effect' within the chest cavity of the user. In this way, the user's chest can be made to naturally resonate in substantial synchronism with the sound, which provides a physical sensation to the user as well as providing a perceived bass component to the sound.

The audio device may be arranged such that the transducer is placed against the body of the user. The audio device may be placed against the body of the user, such that the transducer is oriented to allow at least part, and preferably most, of the output sound to be directed substantially towards the user's body. As a result, this orientation maximises the amount of sound energy that is available for inducing the body's natural response, as the body is able to absorb more of the sound energy than if the transducer were directed away from the body.

Alternatively, the audio device may be arranged such that the transducer is directed away from the body so that the high frequencies produced by the transducer are preferentially directed away from the body for the user's listening enjoyment. Since the low frequencies produced by the transducer are generally non-directional, a higher proportion of low frequencies than high frequencies may therefore be absorbed by the body of the user.

In exemplary embodiments, the audio device may be positioned on the user's chest. This position is selected to maximise the body's natural resonant response to the sound and to make use of the cavity resonance effect. The audio device may be positioned to be in direct physical contact with the user's chest or else may be in close abutting proximity to the chest, e.g. separated by a relatively thin layer of clothing etc.

It is to be appreciated however, that the audio device may be placed against any part of the user's body in order to induce a physical response, e.g. resonance, to thereby improve the user's listening experience.

The audio device may be attached to the user's body by way of fixing means, which in one embodiment is a lanyard that the user wears around their neck. However, any suitable form of fixing means may be used, including, but not limited to, a harness, a shoulder strap/sash, a clip, a hook and a Velcro™ patch etc. provided that it is able to allow the output sound to be directed towards the body of the user.

Any transducer capable of producing an output sound may be used in conjunction with the method of use of the invention. The transducer may be a conventional audio loudspeaker of moving coil or moving magnet device etc. that is capable of being driven via an audio signal to produce an audible sound. Hence, it is at least part of the energy of this audible sound that is absorbed by the user's body, which thereby induces a physical response to the sound. Thus, the benefits of the invention can be achieved in the absence of any direct mechanical (e.g. vibrational) coupling between the transducer and the user's body, as it is the transmission, and subsequent absorption, of the sound into the body of the user that causes the user to experience a resonance while listening to the sound.

The transducer may be housed within a separate enclosure to that of a corresponding music player, and hence may be positioned independently of the player, or else be an integral component of the music player, and hence be positioned along with the player. The invention is found to be of particular use with MP3 players and MP3 enabled mobile telephones, i.e. those telephones having a built-in loudspeaker assembly.

The invention may also be put to particularly good effect with stereo reproduction devices, for example, music players and loudspeaker enclosures capable of reproducing a two channel stereo signal (usually known as left and right channels). In this way, not only can a high quality stereophonic sound field be recreated, but the user may also feel the sound while simultaneously hearing the stereo reproduction.

The transducer may be driven by any suitable audio signal, which in most applications is likely to correspond to a mono or stereo music track. Therefore, to achieve the benefits of the invention, the user will play the track on their music player which will then be fed to the transducer to induce a resonant response in the body of the user. In this way, the user may then feel, as well as hear, the music, thereby recreating the effect of actually being present at the time the music was recorded, e.g. such as at a live concert or performance etc.

In some embodiments, a stereophonic sound field may be recreated by way of an audio device comprising a sum and difference speaker system, connected to, or integral with, the music player. Such a device may also have a second transducer that is driven at the time of driving the first transducer, so as to recreate the stereophonic sound field. In this case, the second transducer may be driven with a signal comprising and preferably consisting exclusively of the difference of the left and right channels and the first transducer may be driven with a signal comprising or consisting exclusively of the sum of the left and right channels. The second transducer preferably reproduces two substantially out of phase audio signals and may be associated with means that are able to transmit the out of phase signals from respective spaced apart locations.

However, the use of such a stereo reproduction device is the same as for a single audio loudspeaker, in that the device may be placed against the user so that both the first and second transducers are held in close proximity to, or direct physical contact with, the body of the user.

In another embodiment, it is also possible to achieve the benefits of the invention by simultaneously listening to the music track via headphones and using the transducer to induce a resonance by way of the low frequency components of the output sound. In such an arrangement, the music player may be modified to split the audio signal corresponding to the music track into two identical signals, allowing one of the signals to be passed through a low-pass filter so that only the low frequency components of that signal are fed to the transducer. In this way, the user may still experience the full audio effect by both feeling and hearing the music, but can do so without disturbing other nearby individuals, e.g. commuters, shoppers etc.

Although the present invention is ideally suited for improving a user's listening experience during the reproduction of sound, it will be recognised that one or more of the principles of the invention could also be used in other sound reproduction or audible sensation arrangements, and may have particular application in devices for hearing impaired individuals.

Embodiments of the invention will now be described in detail by way of example and with reference to the accompanying drawings in which.

Figure 1:
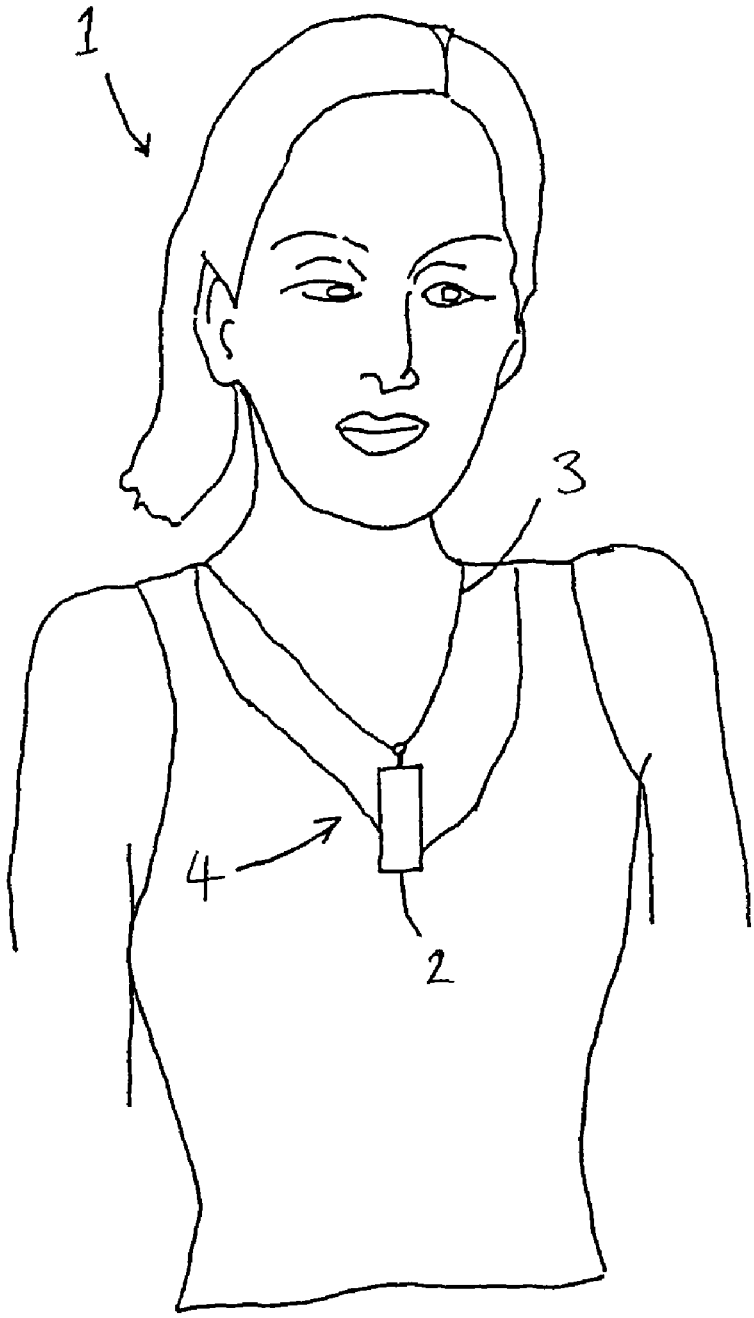
FIG. 1 illustrates a particularly preferred embodiment of how to use an audio device according to the invention.

With reference to FIG. 1, there is shown a particularly preferred embodiment of a method of using an audio device according to the present invention. The user 1 is listening to a music track by way of a MP3 player 2 having an integral audio loudspeaker (not shown). The MP3 player 2 is of conventional design and is dimensioned so as to be a substantially hand-held device. It is to be appreciated however, that the MP3 player 2 may alternatively be a MP3 enabled mobile telephone having a loudspeaker assembly.

The player 2 is provided with a lanyard or strap 3 that passes over the head of the user 1 and holds the player 2 around the neck of the user 1. The lanyard 3 has an adjustable length, so that the player 2 can be positioned at various vertical displacements from the user's neck. In the example of FIG. 1, the user 1 adjusts the lanyard 3 to position the player 2 so that it is placed at substantially the centre of the user's chest 4. This position is selected to maximise the body's natural resonant response to the sound and to make use of the cavity resonance effect in the chest 4. Alternatively, the user 1 may instead simply hold the player 2 at the desired location, without the restriction of the lanyard 3.

The user 1 orientates the player 2 by turning the loudspeaker towards her chest 4 and allowing the loudspeaker to rest against her chest 4 in direct physical contact. As a result, the amount of available sound energy for inducing the body's natural resonant response is maximised, as the output sound is directed inwards towards the user's chest 4.

During playback of the music, the output sound induces the user's chest 4 to resonate via a cavity resonance effect within her chest 4, due to low frequency stimulation arising from the low frequency components of the output sound. In this way, the user 1 is now able to feel as well as hear the music, thereby improving their enjoyment of the reproduced sound and enhancing their overall listening experience.

By using a player 2 in the manner of the present invention, the low frequency end of the recorded sound can be reliably reproduced by making use of the body's natural physical response to the sound. All too often this low frequency end is lost due to the limited low frequency response and low fidelity (i.e. low output power) of conventional listening devices, such as headphones and integral loudspeakers of music players—which typically degrades the listening experience for the user. Thus, in accordance with the present invention, the full audio effect of the recorded sound can be reproduced and appreciated, leading to a more rewarding and fulfilling experience for the user 1.

Therefore, it should be understood that the present invention provides significant advantages over conventional methods of reproducing music via portable music players with headphones or integral loudspeakers, as existing arrangements are typically unable to reproduce low frequency components of the recorded sound with sufficient fidelity or output power to induce a physical response in the user. By contrast in the present invention, by driving an audio transducer that is placed against the body of the user, it becomes possible to induce the user to respond to the music in the same, or substantially similar, way to that as if they were experiencing the music in a live environment, i.e. to physically 'feel' the low frequency components. Hence, the invention is able to substantially recreate the full audio effect that would be experienced by the user if they were present in a rock concert or classical music hall etc., all by virtue of a portable music player.

Figure 2:
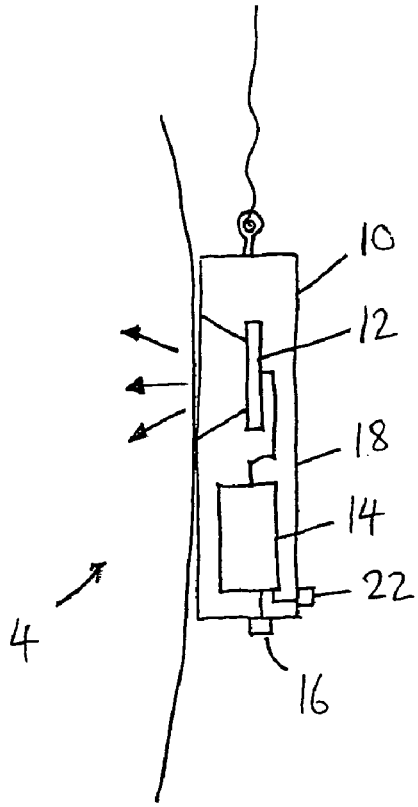
FIG. 2 is a schematic representation of a preferred audio device for use in the manner of FIG. 1.
Figure 3:
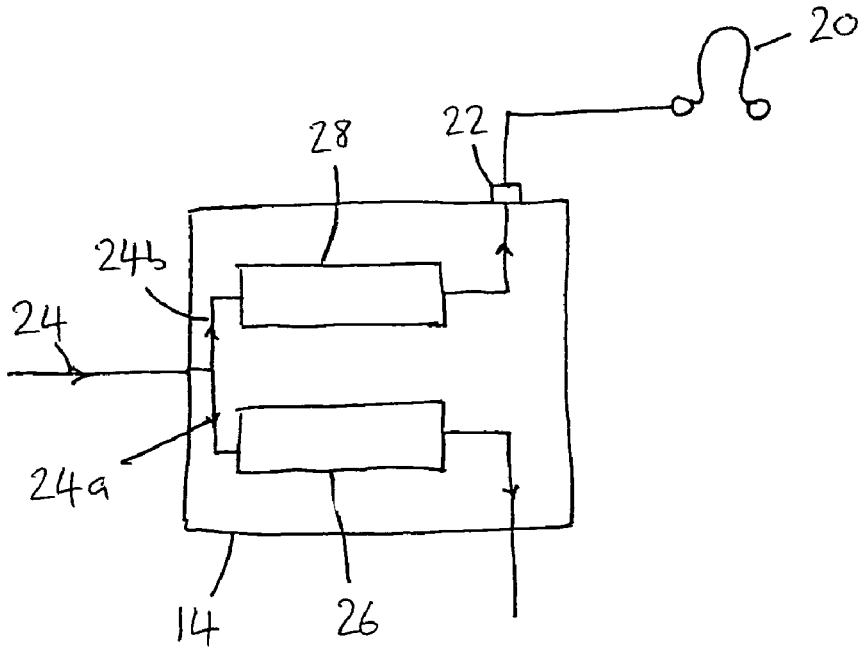
FIG. 3 is a schematic representation of a preferred audio driving circuit within the audio device of FIG. 2.

Referring to FIGS. 2 and 3, there is shown an example of a particularly suitable listening device 10 for use in conjunction with the method of the present invention. The listening device 10 is intended to be used with a music player, such as a MP3 player, and comprises a conventional audio loudspeaker 12 for producing output sound. The listening device 10 is enclosed within a lightweight plastic housing 18 and is connected to the player via a standard jack socket 16 located in the base of the housing 18.

During playback of the music, the listening device 10 can be used both with, and without, external headphones 20 while still achieving the benefits of the present invention.

The user positions the listening device 10 against their chest 4 so that the loudspeaker 12 is placed in direct contact with their chest 4. The loudspeaker 12 faces inwards towards the user's chest 4 so that the output sound is projected into the user's chest area (as indicated by the arrows in FIG. 2).

The listening device 10 includes an audio driving circuit 14 that can drive the loudspeaker 12 according to either mono or stereo signals. The driving circuit 14 splits the input audio signal 24 (from the player) into two identical signals 24*a*, 24*b*. If the user decides to operate the listening device 10 in a private mode, i.e. with the use of headphones 20 to avoid disturbing other individuals, she can insert the headphones 20 into jack plug 22 which causes the driving circuit 14 to apply a low-pass filter stage 26 to the signal 24*a* driving the loudspeaker 12. As a result, only the low frequency components of the output sound are then fed to the loudspeaker 12. However, it is these low frequency components that induce the chest to resonate in synchronism with the music, and thus the user can still benefit from the resonance effect of the invention while listening to the music via the headphones 20.

Therefore, the user can enjoy an improved listening experience whether they listen to the music via the loudspeaker 12 only or via the combination of the headphones 20 and loudspeaker 12.

In an arrangement such as that described above, it is also possible to apply a filter stage 28 to the headphone audio signal 24*b* as shown in FIG. 3, depending on the particular application and desired quality of the reproduced sound.

Figure 4:
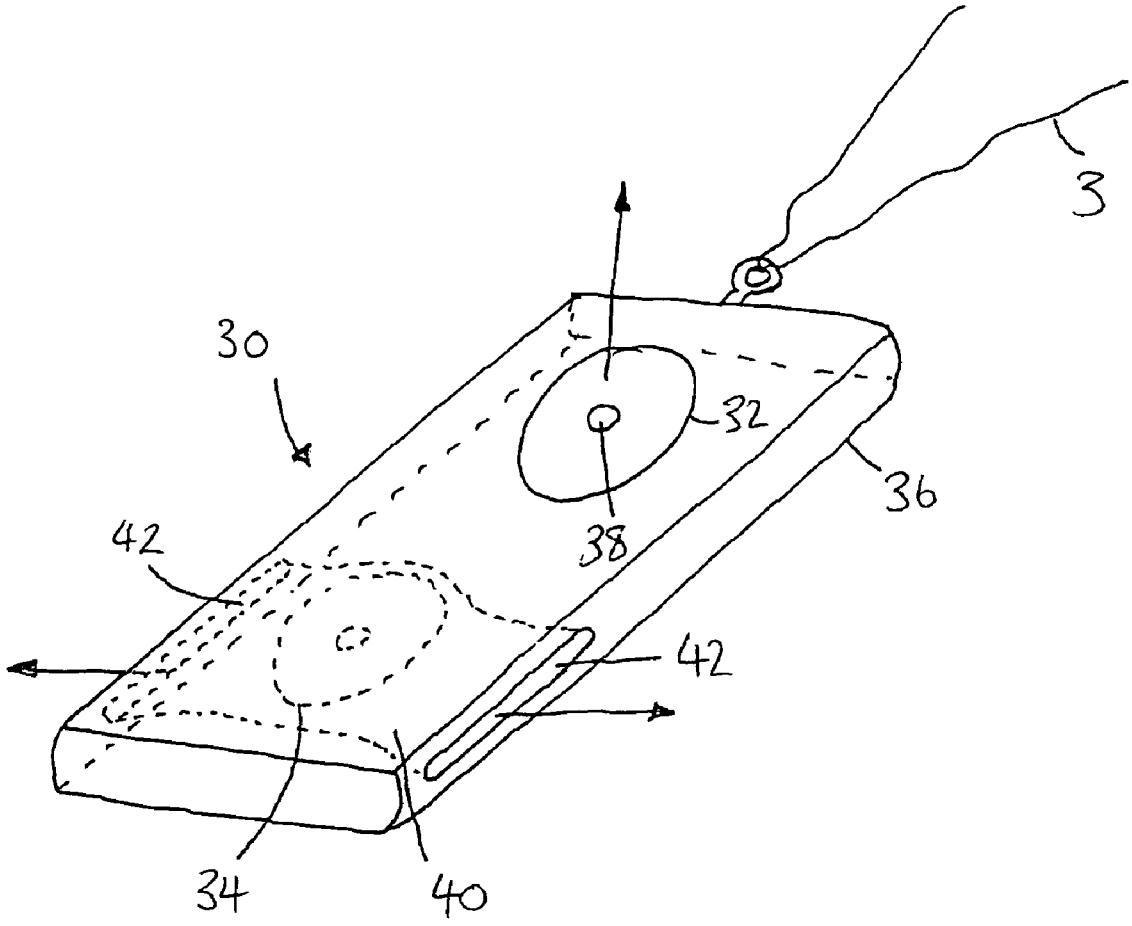
FIG. 4 is a perspective view of a sum and difference loudspeaker enclosure for use in the manner of FIG. 1.

As discussed earlier, it is also possible to use the method of the present invention with stereophonic sound reproduction devices, such as those based on sum and difference stereo systems. Referring now to FIG. 4, there is shown a particularly preferred embodiment of a sum and difference loudspeaker enclosure 30 for use with the present invention. In this example, the loudspeaker enclosure 30 is dimensioned to be an independent substantially hand-held device, but it could also be incorporated into a handset of a mobile phone, the casing of a MP3 player, a PDA or other hand-held electronic equipment.

The loudspeaker enclosure 30 includes two audio loudspeakers, one a mono loudspeaker 32 and the another a dipole loudspeaker 34. Each are of a "button" type, having an almost flat diaphragm to enable them to be accommodated in a relatively slim housing 36 intended to be worn and/or fixed around the user's neck via a lanyard 3.

The mono loudspeaker 32 is disposed in a cavity in the housing 36. An aperture 38 is formed in the top of the housing 36 and opens into the cavity. The mono loudspeaker 32 is arranged to transmit an audio signal through the cavity. As shown in FIG. 4, the dipole loudspeaker 34 lies adjacent, but spaced apart, from the mono loudspeaker 32 in substantially the same plane as the mono loudspeaker 32. The dipole loudspeaker is also disposed in a cavity which divides it into two separate portions each of which serve as a duct 40, one extending above and the other below the dipole loudspeaker 34 (as shown as ghost lines in FIG. 4). Each of the two portions of the duct 40 communicate with a respective elongate aperture 42 disposed on opposing lateral sides of the housing 36.

In accordance with the method of the present invention, the user positions the loudspeaker enclosure 30 so that the aperture 38 above the mono loudspeaker 32 is placed against the chest 4 of the user 1, with the plane of the mono and dipole loudspeakers being substantially parallel to the surface of the chest.

During playback of stereo music, the mono and dipole loudspeakers are driven by a driving circuit (not shown) that operates according to a sum and difference system. The driving circuit is integral with the music player, but can alternatively be built into the loudspeaker enclosure 30 itself. The driving circuit accepts two stereo input signals (i.e. left and right) that are fed into a sum and difference matrix. The sum and difference matrix is arranged to produce two outputs: a sum output which comprises the sum of both input signals (i.e. left+right); and a difference output which comprises the difference of the input signals (i.e. left−right).

The sum output is connected to a bass lift compensation circuit. This adds gain of about 3 dB to low frequency components of the signal, typically frequencies between 40 and 500 Hz. The output of the bass lift compensation circuit is connected via a power amplifier to the mono loudspeaker 32. The difference output is connected to a high pass filter operative to reduce the amplitude of frequencies below 100 Hz by at least 3 dB. The filtered signal is then subjected to a gain make up of about 4 dB by an amplifier, the output of which is connected via a power amplifier to the dipole loudspeaker 34.

The power amplifier associated with the dipole loudspeaker 34 need only have around 10% to 20% of the power output of that associated with the mono loudspeaker 32.

The dipole loudspeaker 34 is arranged to transmit respective audio sound signals, 180 degrees out of phase with each other, through the respective elongate apertures 42. The duct 40 physically separates the points from which the two out of phase signals are transmitted. This significantly reduces interference between these signals, which is advantageous as occurrence of interference serves to cancel out these signals, resulting in a loss of spatial information. However, reproduction of low frequency components by the dipole loudspeaker 34 is poor compared to that of the mono loudspeaker 32. This is because, despite the presence of the duct 40, significant cancellation of low frequencies occurs due to their inherently longer wavelengths.

Poor reproduction of the low frequency components is compensated for however by boosting the amplitude of low frequencies in the sum signal driving the mono loudspeaker 32. This in turn enables low frequencies to be cut out of the difference signal by means of the high pass filter, improving the integrity of the audio difference signal.

Hence, it will be noted that the use of a sum and difference system is particularly well suited for portable music applications according to the present invention, as boosting the sum signal to the mono loudspeaker increases the bass response of the output sound directed towards the user's chest. This is turn reinforces the fidelity of the low frequency components of the signal, which consequently induces an increased resonance response within the user's chest. Correspondingly, this reduces the reliance on the difference signal to play any significant part in the stimulation of the user's chest, so that the low frequency components can be filtered out to improve the integrity of the difference signal, which allows the dipole loudspeaker to reproduce the stereophonic sound field with much improved quality and clarity of sound.

Moreover, as the apertures 42 and duct 40 are arranged to transmit sound substantially parallel to the surface of the chest 4, the out of phase signals are essentially unimpeded by the user's body, allowing the resulting stereo sound signal to be clearly heard by the user during playback of the music.

Hence, the use of a sum and difference system in conjunction with a portable music player, not only allows the user 1 to experience a high quality stereo sound reproduction, but also allows her to feel the sound while listening to the music. Hence, in this way, the user's enjoyment of the listening experience is significantly improved over other conventional techniques of playing music via portable devices.

The above embodiments are described by way of example only. Many variations are possible without departing from the invention.

The invention claimed is:

1. A method of using an audio device for improving a user's listening experience, the audio device having a transducer for producing output sound, the method comprising the steps of:

driving the transducer to produce an output sound, wherein the transducer is a mono loudspeaker; and placing the audio device against the body of the user so that the user experiences a physical response to the sound while simultaneously listening to the audio device, wherein the audio device has a second transducer for producing output sound and wherein the second transducer is a dipole loudspeaker; and driving the second transducer to produce an output sound, wherein the dipole loudspeaker lies adjacent and spaced apart from the mono loudspeaker in substantially the same plane as the mono loudspeaker and the dipole loudspeaker is disposed in a cavity which divides the dipole loudspeaker into a first portion and a second portion each of which serves as a duct, and the first portion is above the dipole loudspeaker and the second portion is below the dipole loudspeaker wherein the transducer is arranged to produce a resonance in a chest cavity of the user's body.

2. A method as claimed in claim 1 wherein the transducer is placed against the body of the user.

3. A method as claimed in claim 1 wherein the output sound of the transducer comprises sound in a frequency range of 40 to 500 Hz.

4. A method as claimed in claim 1 wherein the audio device is placed against the body of the user such that it is oriented to allow at least part of the output sound to be directed substantially towards the user's body.

5. A method as claimed in claim 1 wherein the audio device is positioned on the user's chest.

6. A method as claimed in claim 1 wherein the transducer is an audio loudspeaker capable of being driven via an audio signal to produce an audible sound.

7. A method as claimed in claim 1 wherein the audio device comprises a sum and difference speaker system.

8. A method as claimed in claim 1 wherein the audio device splits an audio signal into two signals, one signal being passed through a low-pass filter and fed to the transducer, the other signal being fed to another transducer.

9. A method as claimed in claim 1 wherein the second transducer recreates a stereophonic sound field.

10. A method as claimed in claim 1 wherein the transducers are driven by a driving circuit which accepts a left input signal and a right input signal and produces a first output comprising a sum of the input signals (left+right) and a second output comprising a difference of the input signals (left−right).

11. A method as claimed in claim 10 wherein the first output is boosted by a bass lift compensation circuit.

12. A method as claimed in claim 10 wherein the first transducer is driven by the first output and the second transducer is driven by the second output.

13. A method as claimed in claim 1 wherein the second transducer reproduces two substantially out of phase audio signals.

14. A method as claimed in claim 13 wherein the second transducer is associated with means that are able to transmit the out of phase signals from respective spaced apart locations.

15. A method as claimed in claim 13 wherein the out of phase signals are transmitted in a direction substantially parallel to a surface of the body of the user.

* * * * *